United States Patent [19]

Szott et al.

[11] 4,159,014

[45] Jun. 26, 1979

[54] METHOD AND APPARATUS FOR PREPARATION AND CONTROL OF AIR-FUEL MIXTURE TO THE AIR INTAKE OF AN ENGINE

[75] Inventors: Ryszard Szott; Wieslaw Wiatrak; Jerzy Slawik; Marian Polaczek; Wojciech Okulicz; Wojciech Trybus, all of Bielsko-Biala, Poland

[73] Assignee: Osrodek Badawczo-Rozwojowy Samochodow Malolitrazowych "Bosmal", Luksemburg, Poland

[21] Appl. No.: 827,024

[22] Filed: Aug. 23, 1977

[51] Int. Cl.[2] ..... F02B 31/00; F02M 25/06

[52] U.S. Cl. ..... 123/119 R; 123/33 E; 123/119 A; 261/30; 261/34 A; 261/116; 261/DIG. 51

[58] Field of Search ..... 123/119 A, 33 E, 119 R, 123/119 C; 261/30, 34 A, 116, DIG. 51

[56] References Cited

U.S. PATENT DOCUMENTS

| | | | |
|---|---|---|---|
| 1,460,667 | 7/1923 | Good | 261/DIG. 51 |
| 1,886,989 | 11/1932 | Trumble | 261/DIG. 51 |
| 1,901,848 | 3/1933 | Moore | 261/DIG. 51 |
| 1,901,849 | 3/1933 | Moore | 261/DIG. 51 |
| 1,926,010 | 9/1933 | Moore | 261/DIG. 51 |
| 2,012,564 | 8/1935 | Holmes | 261/DIG. 51 |
| 2,013,734 | 9/1935 | Prentiss | 261/30 |
| 2,160,309 | 5/1939 | Huffman | 261/DIG. 51 |
| 2,589,536 | 3/1952 | Carbonaro | 123/119 A |
| 3,531,094 | 9/1970 | Andrew | 261/30 |

FOREIGN PATENT DOCUMENTS

| | | | |
|---|---|---|---|
| 524614 | 5/1921 | France | 261/DIG. 51 |

*Primary Examiner*—Wendell E. Burns
*Attorney, Agent, or Firm*—Haseltine, Lake & Waters

[57] ABSTRACT

A method and apparatus for the preparation and control of an air-fuel mixture to the air intake of an engine in which the fuel is continuously delivered to a multi-stage atomizer by a gas at a pressure higher than the ambient pressure, the pressure of the gas being controlled in accordance with the engine speed and load. The fuel is continuously atomized and homogenized, preferably several times, in the atomizer. The atomizer is installed in the engine air intake ahead of the throttle and the fuel is atomized by the gas delivered through a passage, and the mixture thus prepared is introduced into the air intake above the throttle where it is mixed with the air induced by the engine to charge the engine cylinders.

14 Claims, 7 Drawing Figures

METHOD AND APPARATUS FOR PREPARATION AND CONTROL OF AIR-FUEL MIXTURE TO THE AIR INTAKE OF AN ENGINE

FIELD OF THE INVENTION

This invention relates to a method and apparatus for the preparation of an air-fuel mixture especially in internal combustion engines with spark ignition.

BACKGROUND

There are many methods known and used in the art of atomization of liquid fuels by means of a high-velocity gas to feed internal combustion engines with spark ignition.

The most popular method for atomization of fuel is the use of a venturi tube used in a carburetor. Less popular are the carburetors with an adjustable venturi, and there are also modern methods used which aim at the improvement of fuel feed systems, these modern methods including: atomization in a sonic Dresserator carburetor with adjustable venturi, atomization in a sonic-type idle-run nozzle developed by the Ford Motor Company, the Autotronics Induction System used by the Jet Propulsion Laboratory - California Institute of Technology, atomization in sonic nozzles manufactured by the Modular Sonics Corporation and by the Sonic Development Corporation of America and used in modified versions by the Olson Engineering Company, and fuel injection systems with air delivered to the injector, these systems being developed by the Deutsche Vergaser Gesellschaft and also by the Tecalemit-Jackson.

None of the methods, however, known in the art uses a principle on which the method of this invention is based.

The imperfection of the methods known in the art is either the use of highly complicated equipment for the atomization of fuel, particularly the systems to control the ratio and the rate of air-fuel mixture, or insufficient good atomization of fuel and poor precision in control of the mixture in view of the high requirements which modern engines have to meet as regards the cleanness and efficiency of combustion.

SUMMARY OF THE INVENTION

An object of the present invention is to develop a method for quantitative and qualitative precise control of mixture, this method providing simultaneously a suitable atomization and homogenity of this mixture by means of a simple and relatively inexpensive apparatus.

This object has been accomplished.

In accordance with the invented method for preparation of a fuel-air mixture, the fuel is continuously induced at the atomizer nozzles or delivered and induced from the float chamber by means of air or by means of other gases, e.g. exhaust gases. At a pressure higher than the ambient pressure, the amount of this gas being from a few to tens percent of the charge induced by the engine, the amount of the drawn fuel being proportional to the pressure of the said gas, said pressure being controlled by means of a conditioning and control system, the control action of the said system being governed by the speed and load of the engine, and if necessary by other auxiliary parameters, so that the mixture ratio giving a maximum effective pressure is obtained in the range of engine full loads, and that a mixture ratio giving the minimum consumption of fuel and/or giving a minimum amount of toxic components in the exhaust gases is obtained in the range of partial loads of engine, the fuel being, at the same time, continuously atomized and homogenized, preferably several times, by means of the atomizer installed in the inlet manifold of the engine before the throttle, and the gas under the pressure controlled as described above can be used for certain stages of atomization, while for other stages of atomization the gas, e.g. exhaust gases, under a pressure different from the controlled pressure can be used, a mixture thus prepared being introduced to the inlet manifold of the engine before the throttle where it is mixed with the air induced by the engine to charge the cylinders in a conventional way, said throttle being preferably arranged so that an axial flow of the mixture is possible. During idling of the engine when the demand of fuel is small and the quality of atomization is poor, a high difference of pressures existing above and below the throttle can successfully be used for a further homogenization of the mixture by causing the previously separated high-velocity streams of mixture to collide and expand, while for coasting conditions when the braking effect of the engine is used, a still higher difference of pressures can be used for cancelling the flow of compressed gas delivered above the atomizer, thus terminating the flow of fuel.

In accordance with the apparatus of the invention for preparation of the air-fuel mixture, said apparatus creating the conditions for a simple quantitative and qualitative control of the engine charge and of the air-fuel ratio and for suitable atomization and homogenization of the mixture, and comprising an atomizer, preferably a multi-stage atomizer, said atomizer being installed in the intake manifold of the engine, preferably before the throttle, and being connected through a fuel delivery passage with the float chamber, and through a passage for the compressed air or other gas, e.g. exhaust gases, with a conditioning and control system, said system controlling the pressure of the said gas and being governed by the engine speed and load, and by other auxiliary parameters, said atomizer including a diffusor to expand the mixture into the intake manifold of the engine above the throttle where the mixture is being mixed with the air induced by the engine to flow then into the engine cylinders.

The multi-stage atomizer of the apparatus consists of a series of nozzles of various shape, size, stages and directions of operation, said atomizer causing the induced, or delivered and induced, fuel to be several times thoroughly atomized and homogenized due to various velocities and flow directions of streams of compressed gas. One or more stages of the said atomizer can be connected with a passage through which a gas of parameters different from those of the compressed gas is delivered, e.g. with the passage through which the exhaust gases are delivered.

The throttle of the apparatus of the invention consists preferably of symmetrically opening elements, the shape of the said elements being suited to the shape of the cross-section of the engine intake manifold. An idling atomizer can be installed in this throttle, said atomizer operating only when the throttle is closed and consisting of a Laval nozzle located on the axis of mixture flow, a port co-axially located under the Laval nozzle being used with another suitably staged nozzle, said latter nozzle expanding the homogenized and atomized mixture under the throttle.

The float chamber of the apparatus according to the invention has a conventional vent hole, said vent hole being connected with the engine intake manifold space above the throttle, or preferably the said float chamber is connected, through a passage, with the passage through which the compressed gas is delivered to the atomizer, this arrangement securing a suitably controlled delivery of the fuel irrespective of fuel induced by the atomizer jets.

The conditioning and control system of the invented apparatus of the invention includes a gas delivery unit, said unit preferably constituting a displacement pump coupled with the engine crankshaft and having preferably a centrifugal governor mounted on the pump shaft, said governor controlling a release valve or a pressure reducing valve, and a unit controlling the conditioning system, said unit regulating the gas pressure, in accordance with engine speed and load, by means of a compensation and control reservoir with passages connecting the said reservoir with the atomizer, by means of a rate throttle, said rate throttle being pneumatically coupled with the pressure existing below of the engine throttle and being mechanically linked with the accelerator pedal in tandem with the engine throttle. In an alternative arrangement, the conditioning system is controlled by means of the rate valve connected with the passage for compressed gas and with the atomizer, said rate valve being controlled either by a pneumatic actuator responding to the pressure existing below the throttle or being mechanically controlled by the accelerator pedal in tandem with the throttle within the range of dynamic control of mixture ratio. In an alternative arrangement, said conditioning system is controlled by an electronic control system where the basic input values for the said electronic control system are: engine speed, position of the accelerator pedal and the mass of air charge induced by the engine: the auxiliary input values for the said electronic system being for, instance, temperature and humidity of induced air, and engine temperature.

Of advantage in the method and apparatus of the invention the quantitative and qualitative precision in the control of the air-fuel mixture, and a good atomization and homogenity of mixture is obtained thus causing the combustion process to be complete with a considerable excess of air, while the volumetric efficiency of the cylinders is improved. In consequence, a higher economy in fuel consumption is achieved, the quantity of toxic constituents in the exhaust gases is reduced, and the overall performance of the engine is improved; i.e. as regards the power and the torque of the engine. The apparatus of the invention is also relatively simple in construction and in production.

BRIEF DESCRIPTION OF THE DRAWINGS

An embodiment of the invention will now be described by way of example and with reference to the accompanying drawings in which.

DETAILED DESCRIPTIONS

Figure 1:
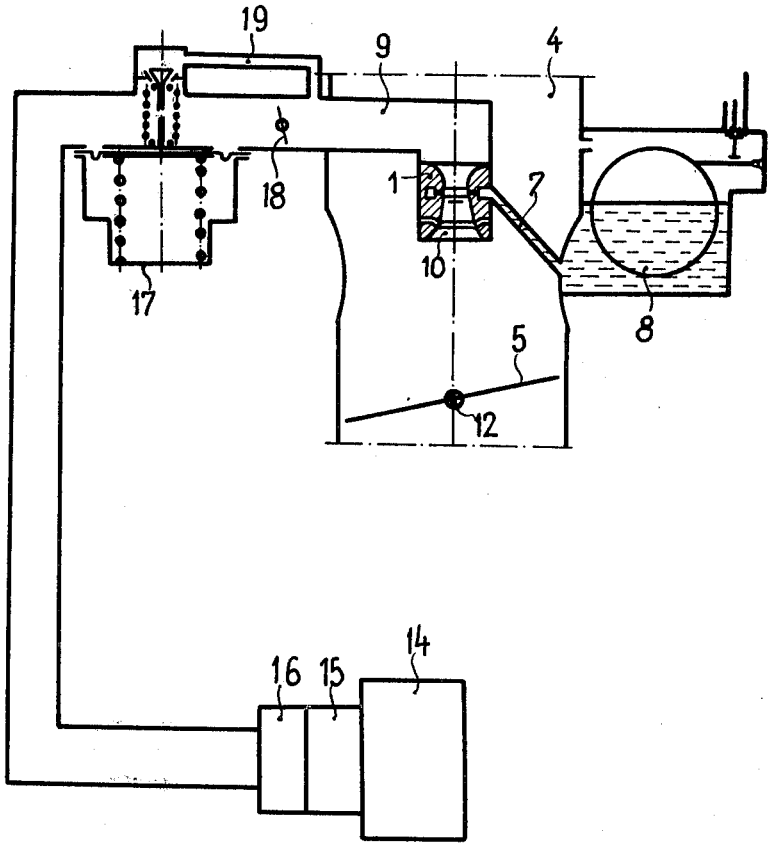
FIG. 1 illustrates the apparatus diagramatically.
Figure 2:
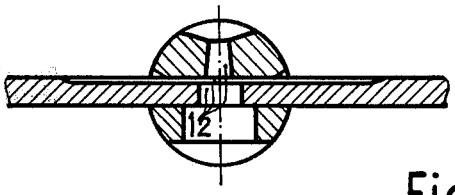
FIG. 2 illustrates the idling atomizer of the apparatus in section.
Figure 3:
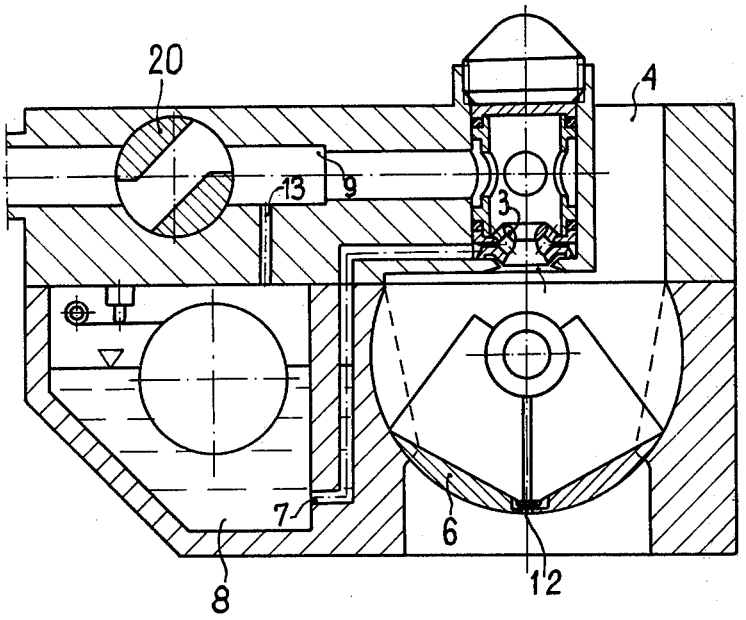
FIG. 3 illustrates in longitudinal section the apparatus in an alternative version.
Figure 4:
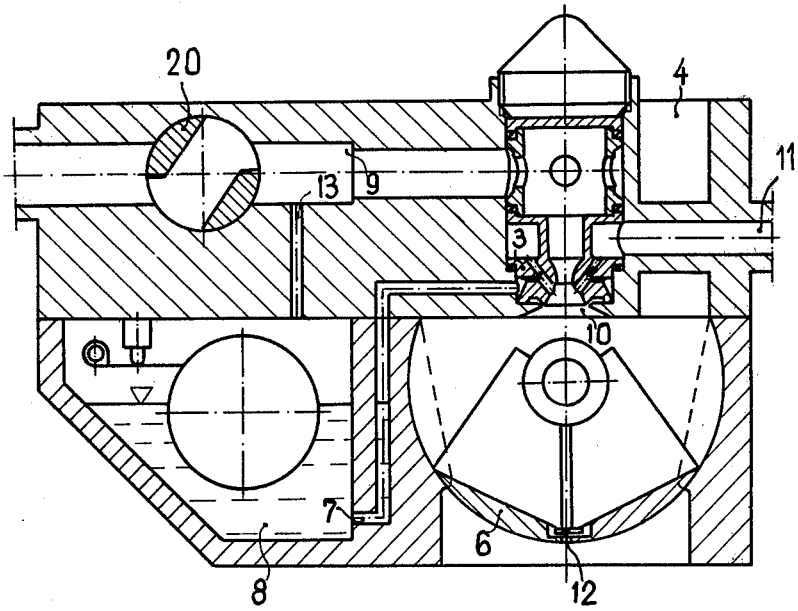
FIG. 4 illustrates in longitudinal section the apparatus with an atomizer in the alternative version.

As it is illustrated in the drawings the apparatus according to the invention alternatively includes an atomizer 1 /FIG. 1/, or an atomizer 2 /FIG. 3, 6/, or an atomizer 3 /FIG. 4, 7/, said atomizer being installed in the intake manifold 4 of the engine before a throttle 5 /FIG. 1/ or before a throttle 6 /FIG. 3, 4/. The atomizer is connected to a float chamber 8 by means of a fuel supply passage 7, and with a conditioning and control system by means of a passage 9, through which air or other gas under a pressure higher than the ambient pressure, e.g. exhaust gases is being supplied.

The pressure of the gas supplied through passage 9 is obtained by conventional methods and is principally controlled by the engine speed and load, and additionally by other parameters. Said pressure determining, at the particular moment, the rate of delivered fuel and serving, at the same time, as an agent for atomizing the fuel and homogenizing the mixture in the successive stages of atomizer 1, 2, 3, said atomizer including at its end a diffuser 10, said diffuser expanding the mixture into the intake manifold 4 of the engine above the throttle 5, 6, where the said mixture is mixed with the air induced by the engine, said mixture flowing then into the engine cylinders.

The multi-stage atomizer 1, or 2, or 3, of the apparatus according to the invention consists of a series of nozzles of various shape, size, stages and directions of operation, and includes the fuel supply passages, said atomizer preferably constituting a self-contained element, said atomizer causing the fuel to be thoroughly atomized and homogenized several times due to various velocities and flow directions of streams of gas. Certain stages of the said atomizer can be supplied with the gas under pressure controlled as described above, the other stages can be supplied with gas of other properties; e.g. one or two stages of atomizer 3 are connected with passage 11 through which the exhaust gases are delivered from the exhaust system.

During idling of the engine when the engine throttle 5, or preferably throttle 6, is closed, said throttle 6 consisting of symmetrically opening elements whose shape is suited to the shape of the cross-section of the engine intake manifold, and when the fuel delivery rate is small and the atomization poor, the high difference of pressures existing above and below throttle 5, 6 can successfully be used to homogenize the mixture further by causing its previously separated high-velocity streams to collide and expand, this being accomplished in an idling atomizer 12, said atomizer consisting of a Laval nozzle, a port situated co-axially below the Laval nozzle, and a further nozzle, said further nozzle being suitably staged and expanding the homogenized and atomized mixture below the throttle 5, 6.

As illustrated in FIG. 1 the float chamber 8 has a conventional vent hole, said vent hole being connected with the engine intake manifold 4, namely with the space of the said manifold above the throttle, or preferably the said chamber is connected, through a passage 13, with passage 9 as shown in FIGS. 3 and 4, thus obtaining an advantageous control of the fuel delivery to the atomizer nozzles simultaneously with fuel induction.

The conditioning and control system of the apparatus includes a gas delivery unit, said unit preferably constituting a displacement pump 14 coupled with the engine crankshaft and having, preferably, a centrifugal governor 15 mounted on the pump shaft, said governor controlling a release valve 16, or said gas delivering unit including a pressure reducing valve. Said conditioning and control system further includes a control unit, said control unit regulating the pressure gas delivered above of the atomizer 1, 2, 3 in accordance with engine speed and load and in accordance with other additional parameters.

In one alternative version shown in FIG. 1 the control system of the apparatus of the invention includes a compensating and control reservoir 17, passage 9 with a rate throttle installed inside, said rate throttle being pneumatically coupled with the pressure existing below the throttle 5 and being mechanically linked with the accelerator pedal in tandem with the throttle 5, and an idling passage 19, said components operating so that during idling when throttles 5, and 18 are closed, the gas flows only through the passage 19. During partial loading of the engine, the gas flows through the passage 9 at a rate in accordance with partial opening of throttle 5 and in accordance with partial opening of the rate throttle 18, whereas during full load of the engine the enriching of the mixture is dynamically controlled. At a fully open throttle 5, by the rate throttle 18 which is coupled in tandem and is opened further. In coasting condition when the braking effect of the engine is used, the throttles 5, 18 and the idling passage 19 of the apparatus are closed.

Figure 5:
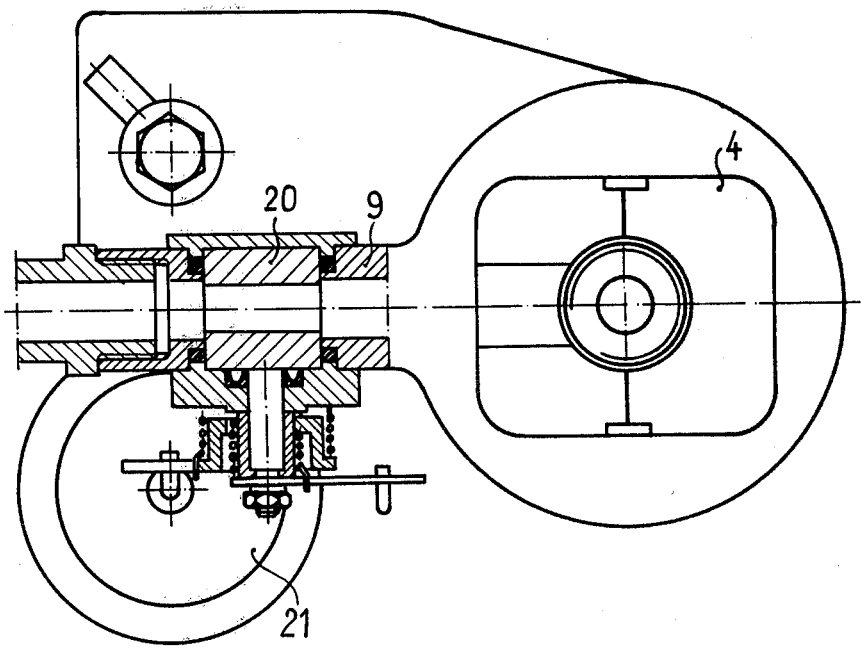
FIG. 5 illustrates the apparatus as viewed from the top and with a rate valve in section.
Figure 6:
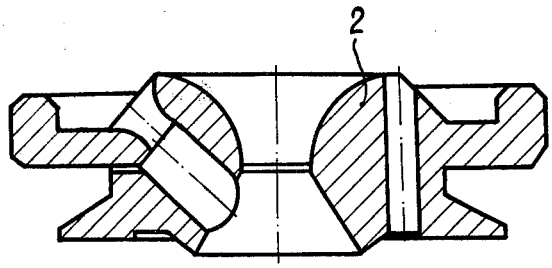
FIG. 6 illustrates in section the atomizer in an alternative version.
Figure 7:
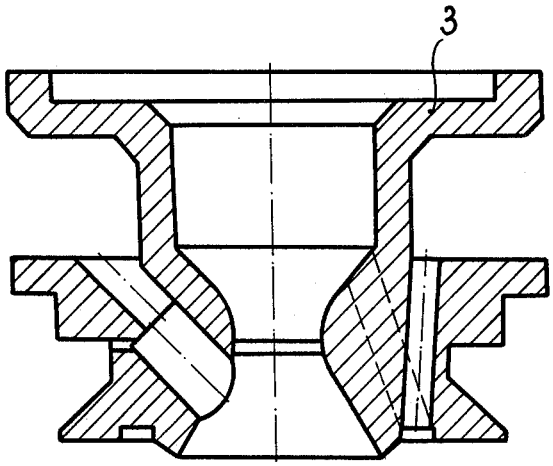
FIG. 7 illustrates in section an alternative version of the atomizer supplied from two sources of gas.

In an alternative version shown in FIGS. 3, 4, and 5 the control system includes a delivery rate valve 20 installed in the passage 9 and controlled by a pneumatic actuator 21 by the value of pressure existing below the throttle, said valve being also mechanically controlled by the accelerator pedal in tandem with throttle 5, 6, said control system operating so that during coasting the delivery rate valve 20 is fully closed, during idling only the port is open as required, at partial load of the engine the delivery rate valve 20 opens as a function of the pressure existing below the throttle 5, 6, said function depending on the engine speed and load, and at full load of the engine the enriching of the mixture is dynamically controlled, at throttle 5, 6 fully open, by the delivery rate valve 20 being further opened mechanically by stepping on the accelerator pedal until the said valve is fully open.

In an alternative version of the apparatus according to the invention, the pressure of the gas delivered to the atomizer 1, 2, 3 is controlled by means of an electronic system directly controlling the pressure and the delivery rate of the pump, or of the pressure reducing valve in accordance with an output signal determined by the input values and data such as the engine speed, the position of accelerator pedal, the mass of the charge induced by the engine, the temperature and the humidity of the air induced by the engine, and the engine temperature.

What we claim is:

1. A method for preparation and control of an air-fuel mixture by fuel atomization using a high-velocity gas as an atomizing agent, said method comprising continuously inducing fuel by a gas at a pressure higher than ambient pressure, the gas being present in an amount from a few percent to tens of percent of the air-fuel mixture charge induced by the engine, the amount of the induced fuel being proportional to the pressure of said gas, controlling said pressure at least by engine speed and load, so that the mixture ratio provides a maximum effective pressure in the range of engine full loads, and a minimum consumption of fuel and a minimum amount of toxic components in the exhaust gases in the range of engine partial loads, while concurrently continuously atomizing and homogenizing the fuel, introducing the mixture thus prepared into the engine intake manifold ahead of the throttle, mixing said mixture in said manifold with air induced by the engine for supplying the charge to the engine cylinders, and during coasting conditions when the braking effect of the engine is utilized and when the throttle is closed a negative pressure downstream of the throttle is utilized for cancelling the delivery of compressed gas to the atomizer thereby interrupting the admission of fuel.

2. A method as claimed in claim 1 wherein the fuel is atomized and homogenized in an atomizer nozzle of fixed flow parameters and the atomization is effected by streams of gas under controlled pressure whereby induction of air and feed of fuel is effected simultaneously and under precise control conditions.

3. A method as claimed in claim 1, wherein during idling of the engine, when the throttle is closed and when the demand for fuel is small and the degree of atomization is low, the difference of pressures existing above and below the throttle, is utilized to homogenize further the air-fuel mixture by causing the previously separated high-velocity streams of mixture to collide and expand.

4. A method as claimed in claim 3 wherein the atomizer has stages in at least one of which said gas under controlled pressure is used for fuel atomization while in at least a second stage a gas of different parameters is used for additional fuel atomization.

5. A method as claimed in claim 1, wherein the throttle is formed with a symmetrical arrangement of throttle elements enabling substantially axial flow of mixture.

6. An apparatus for preparation of an air-fuel mixture comprising an atomizer installed in an intake manifold of an engine upstream of the throttle thereof, a float chamber containing fuel connected to said atomizer, means including a passage for supplying said atomizer with a gas at a pressure higher than ambient pressure, said atomizer including a diffuser at the end thereof opening towards the engine intake manifold above the throttle where the mixture of fuel and gas is mixed with air induced by the engine to produce a charge for the engine cylinders, means for controlling the pressure of the gas supplied to the atomizer, and a delivery rate valve installed in said passage, said delivery rate valve being pneumatically coupled with the intake manifold to respond to the pressure existing below the throttle and being mechanically linked with the accelerator pedal in tandem with the throttle.

7. An apparatus as claimed in claim 6 wherein the means for controlling the pressure of the gas supplied to the atomizer comprises a pump driven by said engine.

8. Apparatus as claimed in claim 6 comprising a further atomizer in said throttle idling of the engine, said further atomizer including, in series, a Laval nozzle situated co-axially with the stream of flowing mixture, a port co-axially situated under said Laval nozzle, and a staged nozzle for expanding the mixture.

9. An apparatus as claimed in claim 6 wherein said throttle comprises symmetrically opening elements having a shape cooperatively corresponding to the shape of the cross-section of the intake manifold.

10. An apparatus as claimed in claim 6 wherein said atomizer is constituted as a combined mechanical element whose flow parameters are constant, the fuel being induced by said atomizer and being delivered at a regulated pressure from the float chamber, said float chamber being connected through a further passage to the first said passage, said controlling means controlling the pressure in said first passage and including a delivery rate valve, and a pneumatic actuator coupled to said delivery rate valve for operating the same, and means for controlling said actuator by the pressure existing in said manifold below the throttle, said delivery rate valve being connected to the accelerator pedal in tandem with the throttle.

11. An apparatus as claimed in claim 6, wherein said controlling means includes an electronic system responsive to input data including engine speed, the position of the gas pedal, the mass of the charge induced by the engine, the temperature and humidity of the air induced by the engine, and engine temperature, said electronic system including a block translating the input data into an output signal to regulate the pressure and the delivery rate of the gas in said passage.

12. An apparatus as claimed in claim 6 further comprising an idling passage connected in parallel with the first said passage upstream and downstream of said delivery rate valve.

13. An apparatus as claimed in claim 6 wherein said pump includes a governor and a release valve coupled to said governor for being operated thereby, and a compensation and control reservoir connected to said pump and said governor.

14. An apparatus as claimed in claim 10, wherein selected stages of said atomizer are connected with the first said passage and other stages are connected with the further passage through which a gas of other properties may be delivered.

* * * * *

UNITED STATES PATENT AND TRADEMARK OFFICE

CERTIFICATE OF CORRECTION

PATENT NO. : 4,159,014
DATED : June 26, 1979
INVENTOR(S) : SZOTT ET AL

It is certified that error appears in the above-identified patent and that said Letters Patent are hereby corrected as shown below:

On the title page

Item 73 change "Luksemburg" to --Bielsko-Biala--

After Item 73 please insert:

--Claims priority, applications Poland

| | |
|---|---|
| Aug. 28, 1976 | 192 084 |
| Oct. 13, 1976 | 193 026 |
| Feb. 11, 1977 | 195 961 |
| May 6, 1977 | 197 978 |
| July 21,1977 | 199 790 |

Signed and Sealed this

*Twenty-seventh* Day of *November 1979*

[SEAL]

*Attest:*

RUTH C. MASON
*Attesting Officer*

LUTRELLE F. PARKER
*Acting Commissioner of Patents and Trademarks*